US008199023B2

(12) United States Patent
Paulino et al.

(10) Patent No.: US 8,199,023 B2
(45) Date of Patent: Jun. 12, 2012

(54) SYSTEMS, METHODS AND APPARATUS FOR TAPPING A METAL ELECTROLYSIS CELL

(75) Inventors: Leonardo Paulino, Maranhao (BR); Donald P. Ziegler, Québec (CA)

(73) Assignee: Alcoa Inc., Pittsburgh, PA (US)

( * ) Notice: Subject to any disclaimer, the term of this patent is extended or adjusted under 35 U.S.C. 154(b) by 775 days.

(21) Appl. No.: 12/252,312

(22) Filed: Oct. 15, 2008

(65) Prior Publication Data

US 2010/0090850 A1 Apr. 15, 2010

(51) Int. Cl.

| | |
|---|---|
| ***G08B 21/00*** | (2006.01) |
| *G01N 27/00* | (2006.01) |
| *G01N 27/42* | (2006.01) |
| *C21D 11/00* | (2006.01) |
| *B03C 5/02* | (2006.01) |
| *C25B 3/06* | (2006.01) |

(52) U.S. Cl. ..... 340/657; 324/71.1; 324/71.4; 324/425; 266/78; 204/670; 205/356

(58) Field of Classification Search ..... 340/657; 324/71.1, 71.4, 425; 205/336; 204/670; 266/78

See application file for complete search history.

(56) References Cited

U.S. PATENT DOCUMENTS

| | | | | |
|---|---|---|---|---|
| 3,259,891 | A | 7/1966 | Coulter et al. | 15/339 |
| 3,361,965 | A | 1/1968 | Coulter et al. | 324/71.1 |
| 3,660,256 | A * | 5/1972 | Lippitt et al. | 205/336 |
| 3,899,402 | A | 8/1975 | Chaudhuri | 204/67 |
| 3,920,447 | A * | 11/1975 | Schroeder et al. | 75/530 |
| 4,459,195 | A * | 7/1984 | Bertaud | 204/247 |
| 4,555,662 | A | 11/1985 | Doutre et al. | 324/71.4 |
| 4,600,800 | A | 7/1986 | Ellison et al. | 568/832 |
| 4,602,990 | A | 7/1986 | Boxall et al. | 204/243 R |
| 5,855,757 | A * | 1/1999 | Sivilotti | 205/367 |
| 6,692,620 | B2 * | 2/2004 | Duruz et al. | 204/245 |
| 2004/0070122 | A1 * | 4/2004 | Mizuno et al. | 266/236 |
| 2004/0253168 | A1 * | 12/2004 | Chu | 423/447.3 |

FOREIGN PATENT DOCUMENTS

| | | |
|---|---|---|
| WO | WO 97/09468 | 3/1997 |
| WO | WO 2008/018805 | 2/2008 |

OTHER PUBLICATIONS

International Search Report and Written Opinion from corresponding International Application No. PCT/US2009/057150, mailed Nov. 18, 2009.

Li et al., *Liquid Metal Cleanliness Analyzer (LiMCA) in Molten Aluminum*, ISIJ International, vol. 41, No. 2, p. 101-110, (2001).

* cited by examiner

*Primary Examiner* — George Bugg
*Assistant Examiner* — Jack Wang
(74) *Attorney, Agent, or Firm* — Greenberg Traurig, LLP

(57) ABSTRACT

The present disclosure relates to systems, methods, and apparatus for extracting molten liquid from an electrolysis cell. In one embodiment, a system includes a container and an electrical characteristic detector. The container comprises a body adapted to contain molten liquid and a spout. The spout includes a base portion, a tip portion and a passageway connecting the base portion to the tip portion. The electrical characteristic detector is coupled to the container and is configured to determine an electrical characteristic associated with the molten liquid as the molten liquid passes into the body of the container via the passageway. A process parameter associated with the removal of the molten liquid from the container may be changed when it is determined that an electrical characteristic associated with the molten liquid has achieved a predetermined threshold.

20 Claims, 6 Drawing Sheets

SYSTEMS, METHODS AND APPARATUS FOR TAPPING A METAL ELECTROLYSIS CELL

BACKGROUND

An electrolysis cell is a container containing an electrolyte through which an externally generated electric current is passed via a system of electrodes (e.g., an anode and cathode) in order to change the composition of a material. For example, an aluminum compound (e.g., $Al_2O_3$) may be decomposed into pure aluminum metal (Al) via an electrolysis cell. After the metal is produced, it is generally removed from the cell via a crucible and vacuum suction system.

SUMMARY OF THE DISCLOSURE

Broadly the instant disclosure relates to systems, methods, and apparatus for extracting liquid (e.g., molten aluminum) from an electrolysis cell. These systems, methods, and apparatus may utilize an electrical characteristic detector that detects at least one electrical characteristic associated with liquid being extracted from the electrolysis cell so as to facilitate removal of a first type of liquid from the electrolysis cell while restricting removal of a second type of liquid.

In one aspect, systems for extracting liquid from an electrolysis cell are provided. In one approach, a system includes a container and an electrical characteristic detector. The container comprises a body adapted to contain molten liquid and a spout comprising a base portion connected to the body of the container. The spout includes a tip portion adapted to engage the molten liquid of the electrolysis cell and a passageway connecting the base portion to the tip portion. The molten liquid of the electrolysis cell may pass into the body of the container via the passageway. In one embodiment, the molten liquid comprises at least one of molten metal and electrolyte, but in other embodiments the molten liquid may include other components. The electrical characteristic detector is coupled to the container and is configured to determine an electrical characteristic associated with the molten liquid as the molten liquid passes into the body of the container via the passageway.

In one embodiment, the electrical characteristic detector may be coupled to a first portion of the spout via a first sensing contact. The electrical characteristic detector may be coupled to a second portion of the spout via a second sensing contact. The first portion of the spout may be electrically isolated from the second portion of the spout. When the molten liquid is present within the passageway, the electrical characteristic detector may be configured to determine an electrical characteristic associated with the molten liquid via the first and second sensing contacts. When the electrical characteristic detector determines that the electrical characteristic associated with the molten liquid has achieved a predetermined threshold, the electrical characteristic detector may output an alarm signal.

In one embodiment, the electrical characteristic is associated with the electrical resistance of the molten liquid. When the electrical characteristic detector determines that the electrical resistance associated with the molten liquid has achieved a predetermined resistivity threshold, the electrical characteristic detector outputs the alarm signal.

In one embodiment, the electrical characteristic is associated with the electrical potential of the molten liquid. When the electrical characteristic detector determines that the electrical potential associated with the molten liquid has achieved a predetermined electrical potential threshold, the electrical characteristic detector outputs the alarm signal.

In one embodiment, the electrical characteristic is associated with the current of the molten liquid. When the electrical characteristic detector determines that the current associated with the molten liquid has achieved a predetermined current threshold, the electrical characteristic detector outputs the alarm signal.

In one embodiment, the electrical characteristic detector may be configured to output an alarm signal when the electrical characteristic detector determines that the electrical characteristic associated with the molten liquid is indicative of the presence of an excess of a first type of liquid. For example, the electrical characteristic detector may be configured to output an alarm signal when the electrical characteristic detector determines that the electrical characteristic associated with the molten liquid is indicative of the presence of excess electrolyte within the molten liquid. In another embodiment, the electrical characteristic detector may be configured to output an alarm signal when the electrical characteristic detector determines that the electrical characteristic associated with the molten liquid is indicative of the presence of excess metal within the molten liquid.

The system may include a sensory indicator in electrical communication with the electrical characteristic detector. The sensory indicator may be configured to receive the alarm signal of the electrical characteristic detector. The sensory indicator may be configured to output a sensory output in response to the alarm signal. In one embodiment, the sensory output may be at least one of a visual alarm and an audible alarm.

In another aspect, methods of extracting liquid from an electrolysis cell are provided. In one approach, a method includes the steps of passing molten liquid of an electrolysis cell through the spout of the container, and detecting, during the passing step and while the molten liquid is located within the spout of the container, an electrical characteristic associated with the molten liquid. In one embodiment, the step of detecting an electrical characteristic associated with the molten liquid may include the steps of passing current proximal a first sensing contact and a second sensing contact, wherein the first and second sensing contacts are capable of electrical communication with at least one of the container and the molten liquid. The detecting step may include measuring at least one electrical characteristic associated with the molten liquid via (i) the first and second sensing contacts and (ii) an electrical characteristic detector in electrical communication with the first and second sensing contacts.

In one embodiment, concomitant to the detecting an electrical characteristic associated with the molten liquid step, an alarm signal may be output via the electrical characteristic detector. In response to this outputting step, a sensory output may be presented. When an electrical characteristic achieves a predetermined threshold, a process parameter may be changed. In one embodiment, the step of changing a process parameter may include one or more of the steps of: (i) decreasing the flow rate of the molten liquid into the container, (ii) repositioning the tip of the spout to a different location in the electrolysis cell, and (iii) terminating the passing the molten liquid step (i.e., stopping flow of molten liquid into the container).

Various ones of the aspects noted hereinabove may be combined to yield systems, methods, and/or apparatus for removing molten liquid from an electrolysis cell and/or adjusting a process parameter associated with the removal of a molten liquid from an electrolysis cell. Moreover, these and other aspects, advantages, and novel features of the disclosure are set forth in part in the description that follows and will become apparent to those skilled in the art upon examination of the following description and figures, or may be learned by practicing the disclosure.

DETAILED DESCRIPTION

Reference will now be made in detail to the accompanying drawings, which at least assist in illustrating various pertinent embodiments of the present disclosure.

Broadly the instant disclosure relates to systems, methods, and apparatus for extracting liquid (e.g., molten aluminum) from an electrolysis cell. These systems, methods, and apparatus may utilize an electrical characteristic detector that detects at least one electrical characteristic associated with liquid being extracted from the electrolysis cell so as to facilitate removal of a first type of liquid from the electrolysis cell while restricting removal of a second type of liquid.

Figure 1:
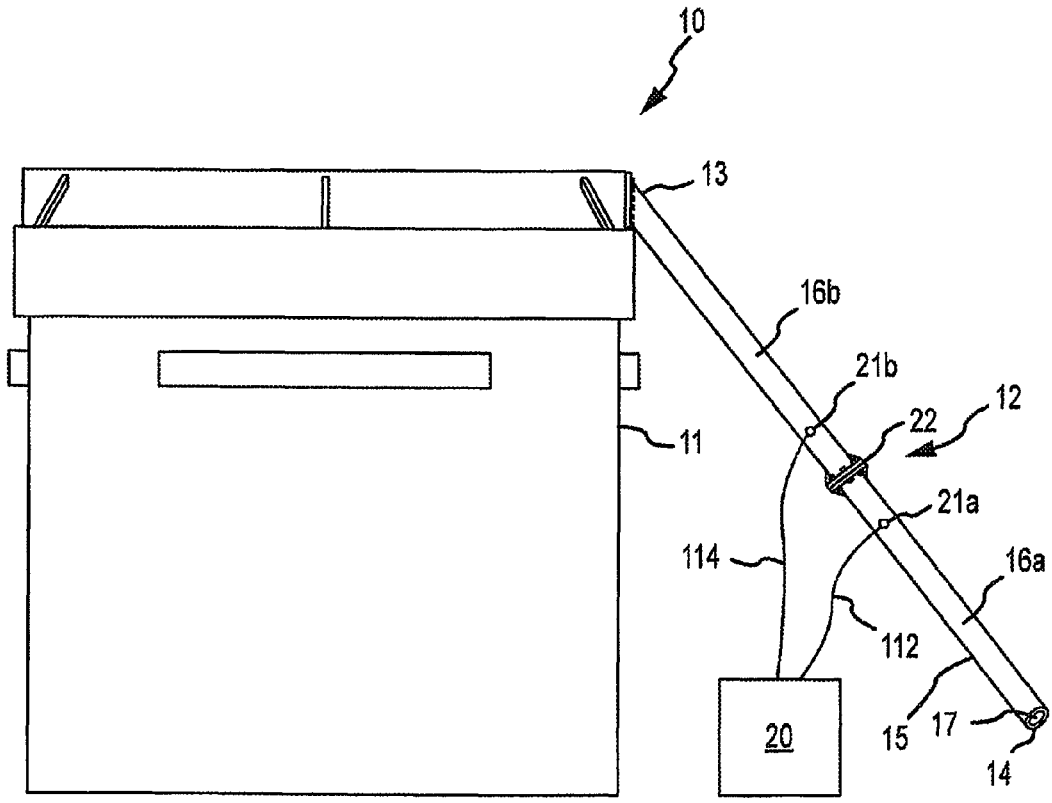
FIG. 1 is a perspective view of one embodiment of a container useful in accordance with the present disclosure.
Figure 2:
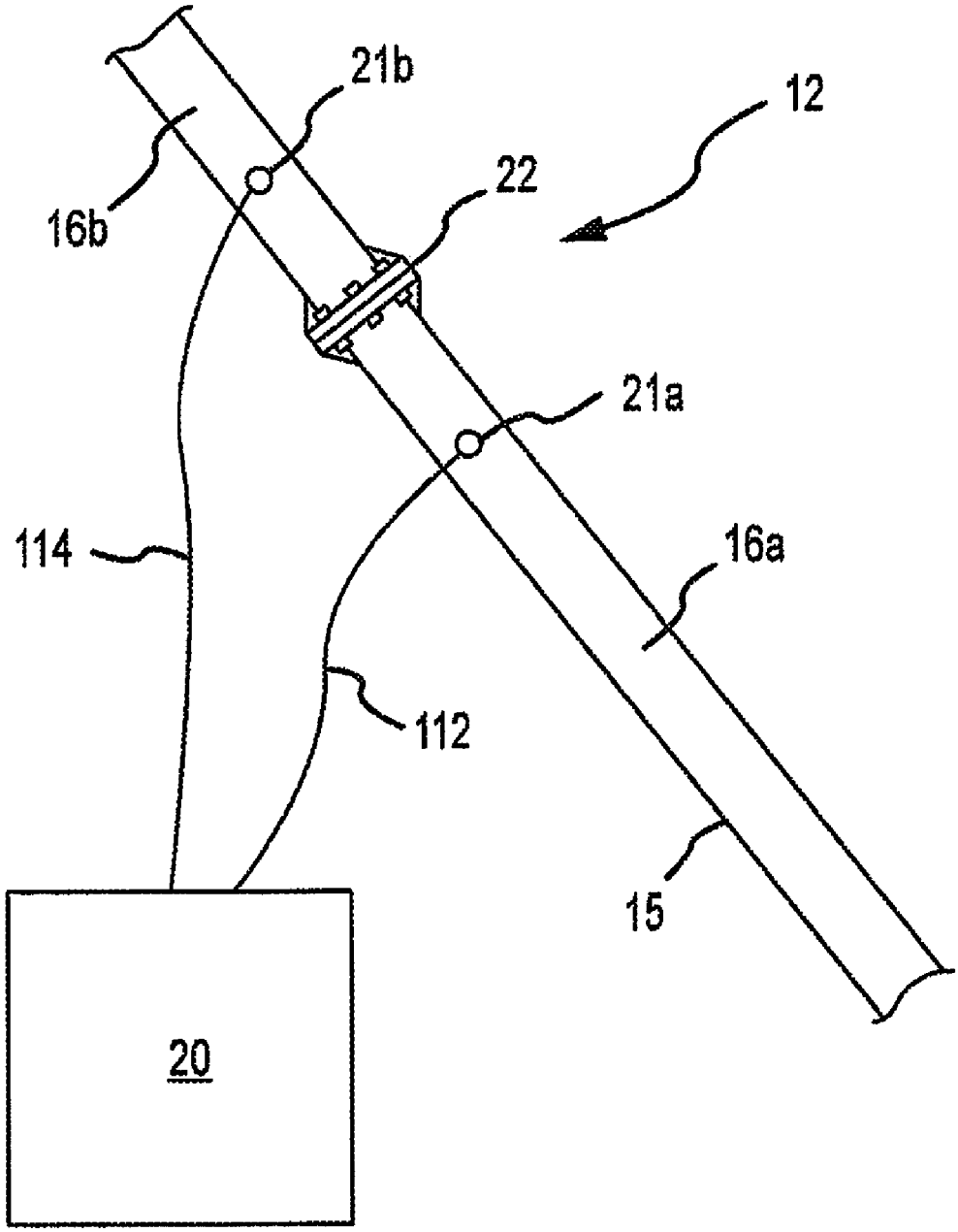
FIG. 2 is a perspective view of one embodiment of the spout of FIG. 1.

For example, and with reference now to FIGS. 1 & 2, an electrical characteristic detector 20 may be electrically coupled to a container 10. The container 10 (e.g., a crucible) has a body 11 adapted to contain molten metal (not illustrated). The container 10 also has a spout 12 comprising a base portion 13, a tip portion 14, and a tube portion 15 connecting the base portion 13 to the tip portion 14. A spout is a member coupled to a container that allows the passage of liquids into or out of the container. The base portion 13 of the spout 12 is connected to the body 11 of the container 10 and a passageway 17 is disposed within the spout 12. The passageway 17 extends at least from the tip portion 14 of the spout 12 to the base portion 13 of the spout 12 to facilitate flow of liquid into the body 11 of the container 10. In other words, the passageway 17 facilitates liquid communication between the tip 14 of the spout 12 and the body 11 of the container 10.

The tip portion 14 of the spout 12 is adapted to engage molten liquid of an electrolysis cell (not illustrated). A molten liquid is any element or compound in liquid form at elevated temperature. For example, in an aluminum electrolysis cell, aluminum metal (Al) and/or cryolite ($Na_3AlF_6$) may make up at least a part of a molten liquid. An electrolysis cell is a container containing an electrolyte through which an externally generated electric current is passed via a system of electrodes (e.g., an anode and a cathode) in order to change the composition of a material. For example, an aluminum compound (e.g., $Al_2O_3$) may be decomposed into pure aluminum metal (Al) via an electrolysis cell.

In the illustrated embodiment, the spout 12 includes an electrical isolator 22, which electrically isolates a first portion of the spout 16*a* from a second portion of the spout 16*b*. Electrically isolated means that a material is set apart from another material so as to restrict or eliminate electrical communication between the two materials. The electrical characteristic detector 20 may be coupled to the spout 12 via wires 112 and 114, and via two sensing contacts 21*a* and 21*b*, the first sensing contact 21*a* being associated with the first portion of the spout 16*a* and the second sensing contact 21*b* being associated with the second portion of the spout 16*b*, and the electrical characteristic detector 20 may be configured to detect electrical characteristics associated with molten liquid passing through the spout 12 and into the body 11 of the container 10.

In operation, liquid of the electrolysis cell may be removed from the electrolysis cell via a vacuum unit (not illustrated) connected to the spout 12. Concomitantly, a constant current may be passed through the spout 12 via an external electrical source. As liquid passes through the spout 12 and proximal the sensing contacts 21*a* and 21*b*, the electrical characteristic detector 20 may determine electrical characteristics associated with the liquid between the first and second sensing contacts 21*a* and 21*b*.

When the molten liquid within the passageway 17 includes mostly a first type of liquid (e.g., molten metal), the measured electrical characteristic value may be a first electrical characteristic value. As the molten liquid includes more of a second type of liquid (e.g., electrolyte) and passes through the spout 12 past the first sensing contact 21*a* and the electrical isolator 22, the electrical characteristic associated with the molten liquid will change and the electrical characteristic detector 20 will measure a second electrical characteristic value.

Figure 3:
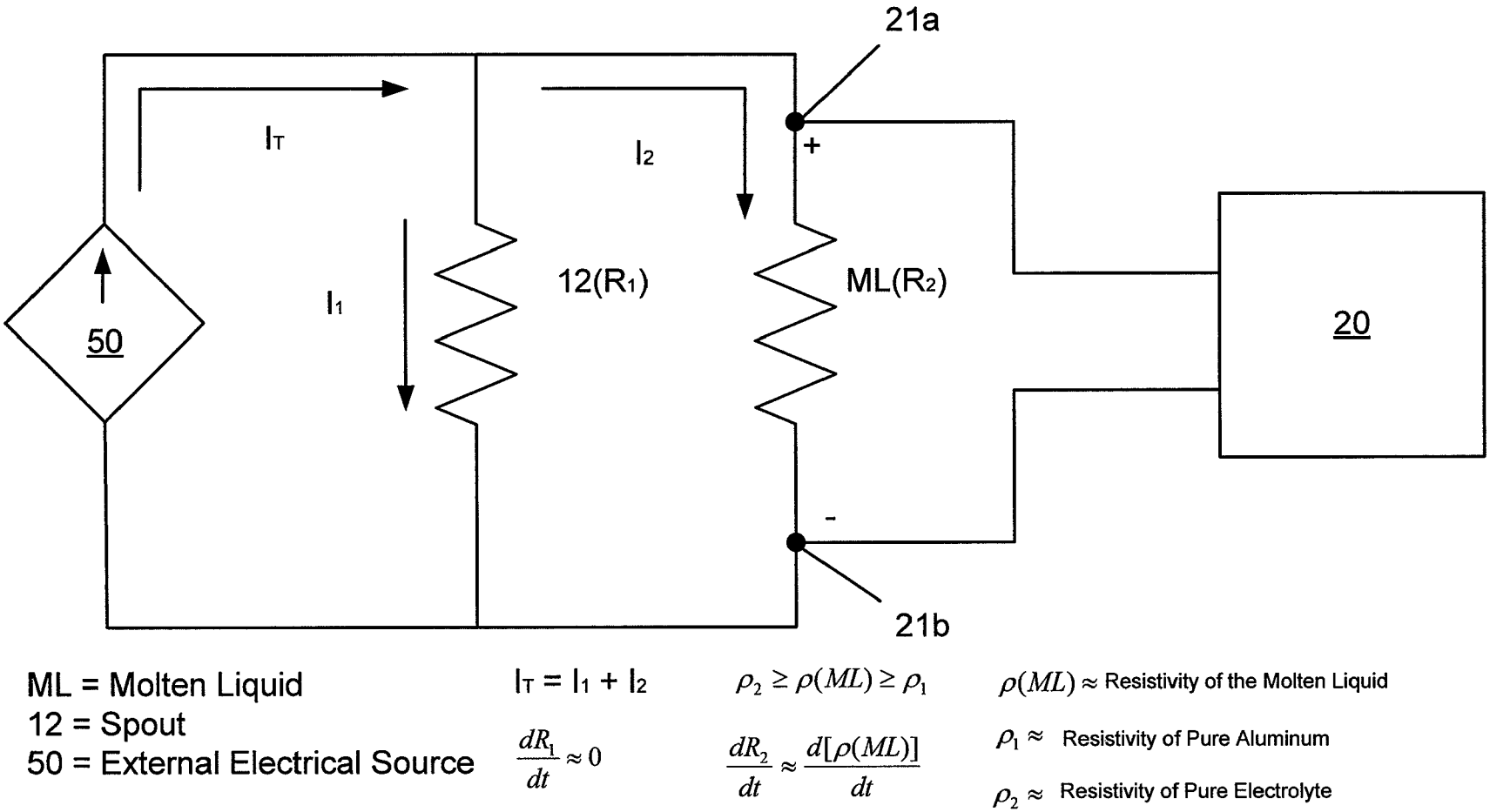
FIG. 3 is a schematic view illustrating one embodiment of a circuit diagram relating to the container of FIG. 1.

A schematic view illustrating one embodiment of a circuit diagram relating to the container of FIG. 1. is illustrated in FIG. 3. As noted above, an external electrical source 50 provides current to the spout 12 of the container 10. The spout 12 provides a parallel path for the current so that the current flows through both the spout 12 and the molten liquid (ML). The first resistor in the circuit ($R_1$) represents the spout 12. The second resistor in the circuit ($R_2$) represents the molten liquid, specifically the molten liquid between the first and second sensing contacts 21*a* and 21*b*. As the molten liquid flows past the first sensing contact 21*a* and the electrical isolator 22, a change in the resistance associated with the molten liquid manifests as a change in the electrical potential difference between the first and second sensing contacts 21*a* and 21*b*. The electrical characteristic detector 20 measures the current and this electrical potential difference between the first and second sensing contacts 21*a* and 21*b*. In turn, the electrical characteristic detector 20 determines the resistance of the molten liquid flowing between the first and second sensing contacts 21*a* and 21*b* from the measured electrical potential difference and current between the first and second sensing contacts 21*a* and 21*b*. When the electrical potential difference changes with respect to time, this change indicates a change in the resistance associated with the molten liquid (ML). The rate of change of the resistance or electrical potential difference associated with the molten liquid (ML) with respect to time corresponds with the rate of change of the composition of the molten liquid with respect to time. Hence, when the rate of change of the resistance or electrical potential difference (or a measured resistance or electrical potential difference value) achieve a predetermined threshold, the electrical characteristic detector 20 may output an alarm signal so as to facilitate changing a process parameter associated with the removal of the molten liquid from the electrolysis cell.

For example, in one approach, it may be useful to remove molten metal from the electrolysis cell while restricting removal of electrolyte. When the molten liquid removed from the electrolysis cell comprises mostly aluminum molten metal, the electrical potential difference between the first and second sensing contacts 21*a* and 21*b* may be a first electrical potential difference value or rate of change. As the molten liquid becomes a mixture of both aluminum molten metal and electrolyte and passes through the spout 12 past the first sensing contact 21*a* and the electrical isolator 22, the electrical potential difference may achieve a second electrical potential difference value or rate of change. This second electrical potential value or rate of change may be associated with a predetermined threshold, and an alarm signal may be output upon achieving the predetermined threshold. A predetermined threshold is a point or a rate of change, which may be determined ahead of time, that is achieved to elicit a response. An alarm signal is a signal (e.g., an electrical or optical signal) that is output from the electrical characteristic detector in response to a measurement of an electrical characteristic associated with a molten liquid. For example, an alarm signal may be output when at least one electrical characteristic associated with a molten liquid has achieved a predetermined threshold.

In another approach, it may be useful to remove electrolyte from the electrolysis cell while restricting removal of molten metal. When the molten liquid removed from the electrolysis cell comprises mostly electrolyte, the electrical potential difference between the first and second sensing contacts 21*a* and 21*b* may be a first electrical potential difference value or rate of change. As the molten liquid becomes a mixture of both electrolyte and aluminum molten metal and passes through the spout 12 past the first sensing contact 21*a* and the electrical isolator 22, the electrical potential difference may achieve a second electrical potential difference value or rate of change. This second electrical potential value or rate of change may be associated with a predetermined threshold, and an alarm signal may be output upon achieving the predetermined threshold.

Figure 4:
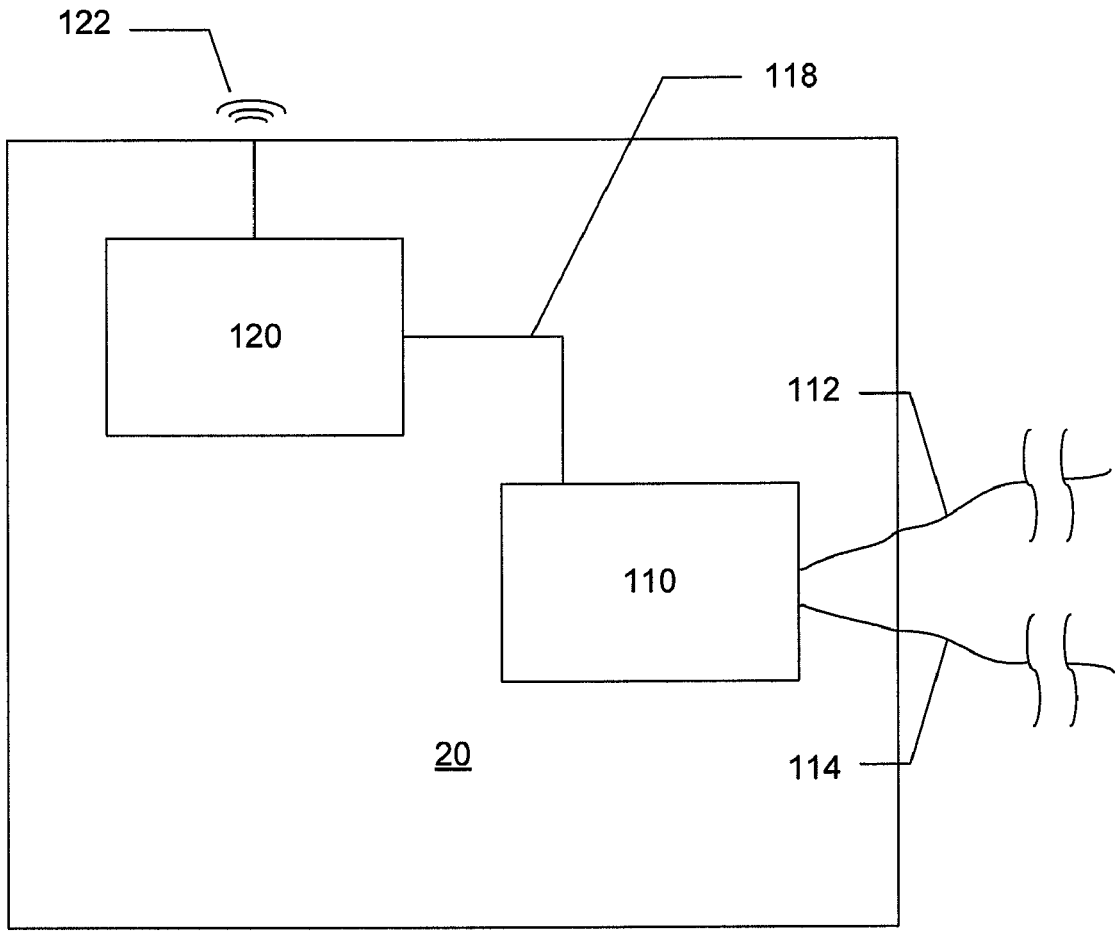
FIG. 4 is a schematic view of one embodiment of the electrical characteristic detector of FIG. 1.

As described above, and with reference now to FIG. 4, when the measured electrical characteristic value achieves a predetermined threshold, the electrical characteristic detector 20 may output an alarm signal. A sensory indicator 120, configured to receive the alarm signal of the electrical characteristic detector 20, may be electrically coupled to or included with the electrical characteristic detector 20 (e.g., via wire 118), and may output a sensory output 122 in response to the alarm signal. A controller 110 may couple the electronic characteristic detector 20 to the sensory indicator 120 via wires 112 and/or 114. In response to the alarm signal and/or the sensory output, a process parameter may change, such as decreasing the flow rate of the molten liquid into the container 10, repositioning the tip 14 of the spout 12 to a different location in the electrolysis cell, or terminating the removal of the molten liquid from the electrolysis cell.

The sensory indicator may be a digital or analog device electrically coupled to or included with the electric characteristic detector. The sensory output is any output that can be comprehended by a living organism, such as any of an audio, visual, tactile, or olfactory output, to name a few. In one embodiment, the sensory output is at least one of an audio output and a visual output. An electrical characteristic detector is any device capable of determining one or more electrical characteristics of a material. Some electrical characteristic detectors useful in conjunction with the instant disclosure include voltmeters, multi-meters, oscilloscopes, spectrum analyzers or filters, to name a few. A sensing contact is a device/apparatus that facilitates coupling of the electrical characteristic detector to a container. For example, an electrically conductive protuberance or indentation of the container, or of the electrical characteristic detector, may be used as a sensing contact. An electrical characteristic is any property of or relating to the presence and flow of electric charge. Some electrical characteristics include voltage, current, resistance, and capacitance. An electrical characteristic associated with a molten liquid is an electrical characteristic that may be measured so as to facilitate the approximation of a physical property of the molten liquid. For example, an electrical characteristic detector may be electrically interconnected to a spout of a container to facilitate determination of an electrical characteristic (e.g., resistance) associated with the molten liquid.

Figure 5A:
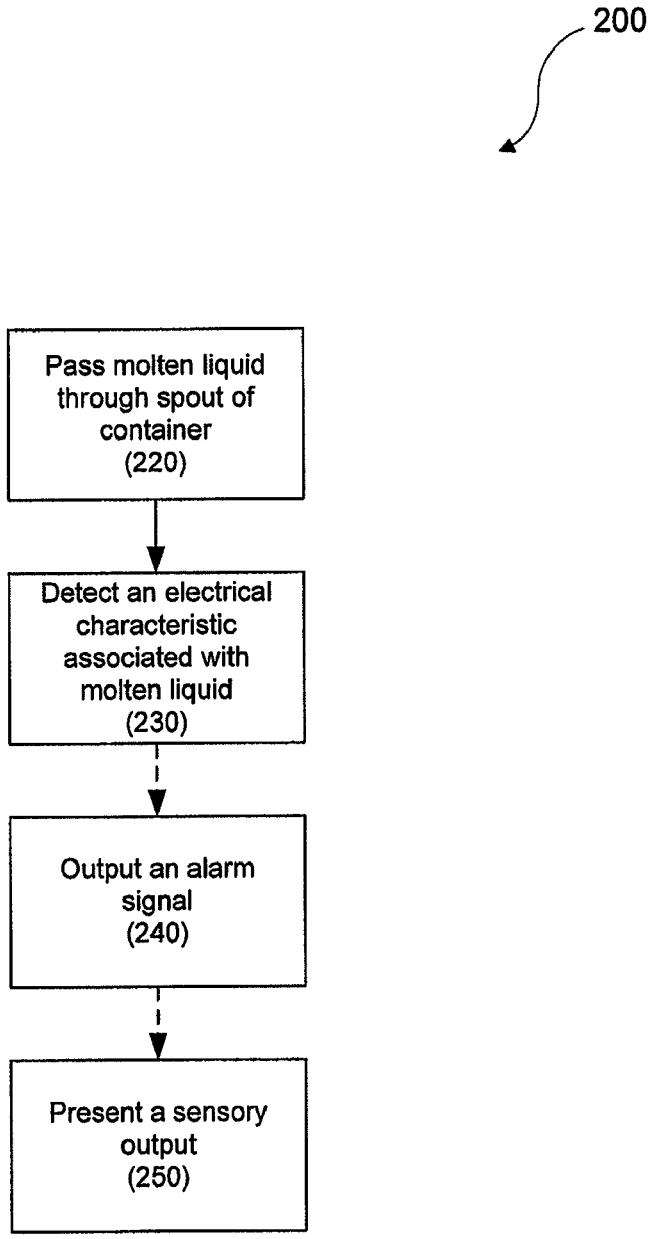
FIG. 5*a* is a flow chart of one embodiment of methods useful in detecting an electrical characteristic associated with a molten liquid.

Methods of tapping electrolysis cells are also provided, one embodiment of which is illustrated in FIG. 5*a*. In the illustrated embodiment, the method (200) includes the steps of passing molten liquid of an electrolysis cell through the spout of the container (220), and detecting an electrical characteristic associated with the molten liquid (230). In one approach, a resistance and/or electrical potential difference associated with the molten liquid is determined. The method may optionally include the step of outputting an alarm signal when the electrical characteristic associated with the molten liquid has achieved a predetermined threshold (240), and/or the step of presenting a sensory output (250) in response to the alarm signal.

Figure 5B:
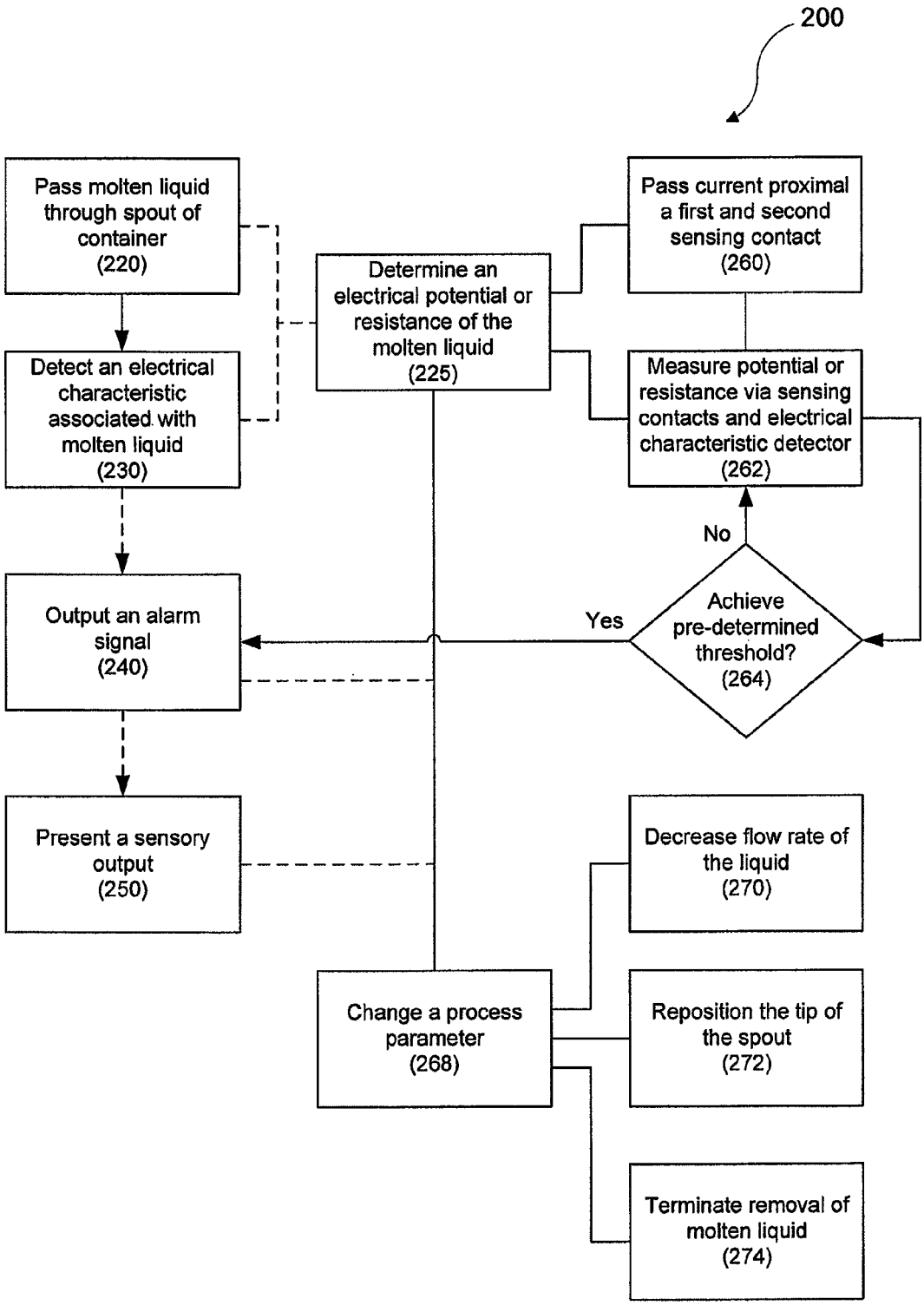
FIG. 5*b* is a flow chart of one embodiment of methods useful in detecting an electrical characteristic associated with a molten liquid.

As noted above, the electrical characteristic detector may determine an electrical potential difference and/or an electrical resistance associated with the molten liquid. With reference now to FIG. 5*b*, this determining step (225) may include passing current proximal a first and a second sensing contact (260) and/or measuring the electrical potential difference or resistance via the sensing contacts and an electrical characteristic detector (262). Additionally, the determining step (225) may include changing a process parameter (268). The resistance or electrical potential value (or rate of change) may be associated with a predetermined threshold. If the predetermined threshold is not achieved (264), the measuring step may continue/be repeated. If the predetermined threshold is achieved (264), an alarm signal may be output (240), which may result in presenting a sensory output (250). In response to the output of the alarm signal (240) and/or the presentation of the sensory output (250), a process parameter may be changed (264). In one approach, a decrease in the flow rate of the liquid into the container (270) may occur. A decrease in the flow rate of liquid into the container may allow for a first liquid to flow into the container, while restricting a second liquid from reaching the container. In another approach, the tip of the spout may be repositioned to a different location in the electrolysis cell (272). Repositioning the tip of the spout to a different location in the cell may increase communication between the spout and a first liquid. In yet another approach, the removal of the molten liquid from the electrolysis cell (274) may be terminated. Stopping the removal of molten liquids may eliminate removal of additional liquid from the electrolysis cell.

While various embodiments of the present invention have been described in detail, it is apparent that modifications and adaptations of those embodiments will occur to those skilled in the art. However, it is to be expressly understood that such modifications and adaptations are within the spirit and scope of the present invention. For example, the molten liquid of an electrolysis cell may include additional components other than metal and electrolyte. The electrolysis cell may also be of a type used to produce other metals, such as magnesium. Also, the first and second sensing contacts may be associated with any portion of the container. Furthermore, the sensing contacts may be in electrical communication with each other so long as the relationship between the current, resistance, and electrical potential difference associated with the molten liquid is consistent in such a way to enable the determination of at least one electrical characteristic associated with a molten liquid. A third liquid and/or additional liquids may be removed from the electrolysis cell and the electrical characteristic detector may detect electrical characteristics associated with this additional liquid so the goal of separating a first liquid from a second liquid or an additional liquid is achieved.

What is claimed is:

1. A system comprising:

(a) a container, wherein the container comprises:

(i) a body, wherein the body is adapted to contain molten metal; and (ii) a spout comprising a base portion, a tip portion, and a passageway connecting the base portion to the tip portion;

wherein the base portion is connected to the body of the container;

wherein the tip portion is adapted to engage a molten liquid of an electrolysis cell; and wherein the molten liquid of the electrolysis cell may pass into the body of the container via the passageway; and (b) an electrical characteristic detector coupled to the container, wherein the electrical characteristic detector is configured to determine an electrical characteristic associated with the molten liquid as the molten liquid passes into the body of the container via the passageway.

2. The system of claim 1, wherein the molten liquid comprises at least one of molten metal and electrolyte, wherein the electrical characteristic detector is configured to output an alarm signal when the electrical characteristic detector determines that the electrical characteristic associated with the molten liquid is indicative of the presence of excess electrolyte within the molten liquid.

3. The system of claim 1, wherein the molten liquid comprises at least one of molten metal and electrolyte, wherein the electrical characteristic detector is configured to output an alarm signal when the electrical characteristic detector determines that the electrical characteristic associated with the molten liquid is indicative of the presence of excess metal within the molten liquid.

4. The system of claim 2, further comprising:

a sensory indicator in electrical communication with the electrical characteristic detector, wherein the sensory indicator is configured to receive the alarm signal of the electrical characteristic detector, wherein the sensory indicator is configured to output a sensory output in response to the alarm signal, and wherein the sensory output is at least one of a visual alarm and an audible alarm.

5. The system of claim 1, wherein the electrical characteristic detector is coupled to a first portion of the spout via a first sensing contact;

wherein the electrical characteristic detector is coupled to a second portion of the spout via a second sensing contact; and wherein the first portion of the spout is electrically isolated from the second portion of the spout.

6. The system of claim 5, wherein, when the molten liquid is present within the passageway, the electrical characteristic detector is configured to determine the electrical characteristic associated with the molten liquid via the first and second sensing contacts.

7. The system of claim 6, wherein the electrical characteristic detector is configured to output an alarm signal when the electrical characteristic detector determines that the electrical characteristic associated with the molten liquid has achieved a predetermined threshold.

8. The system of claim 7, wherein the electrical characteristic is associated with the electrical resistance of the molten liquid, and wherein the electrical characteristic detector is configured to output the alarm signal when the electrical characteristic detector determines that the electrical resistance associated with the molten liquid has achieved a predetermined resistivity value.

9. The system of claim 7, wherein the electrical characteristic is associated with the electrical potential of the molten liquid, and wherein the electrical characteristic detector is configured to output the alarm signal when the electrical characteristic detector determines that the electrical potential associated with the molten liquid has achieved a predetermined electrical potential value.

10. The system of claim 7, further comprising:

a sensory indicator in electrical communication with the electrical characteristic detector, wherein the sensory indicator is configured to receive the alarm signal of the electrical characteristic detector, and wherein the sensory indicator is configured to output a sensory output in response to the alarm signal.

11. The system of claim 10, wherein the sensory output is at least one of a visual alarm and an audible alarm.

12. The system of claim 1, wherein the electrolysis cell is an aluminum electrolysis cell, wherein the molten metal is molten aluminum metal, and wherein the molten liquid comprises at least one of the molten aluminum metal and cryolite.

13. A method comprising:

extracting molten liquid from an electrolysis cell, wherein the extracting step comprises passing the molten liquid of the electrolysis cell through a spout of a container, wherein the container is located external to the electrolysis cell, wherein the container comprises a body configured to contain the molten liquid, wherein the spout is connected to the body of the container, and wherein the molten liquid comprises at least one of molten metal and electrolyte; and detecting, during the passing step and while the molten liquid is located within the spout of the container, an electrical characteristic of the molten liquid that is contained within the spout.

14. The method of claim 13, comprising:

outputting, concomitant to the detecting step, an alarm signal when the electrical characteristic associated with the molten liquid has achieved a predetermined threshold.

15. The method of claim 13, wherein the detecting step comprises:

determining at least one of an electrical potential and an electrical resistance associated with the molten liquid while the molten liquid is located in the spout of the container.

16. The method of claim 15, wherein the determining step comprises:

passing current proximal a first sensing contact and a second sensing contact, wherein the first and second sensing contacts are capable of electrical communication with at least one of the container and the molten liquid; and measuring at least one of the electrical potential and the electrical resistance associated with the molten liquid via (i) the first and second sensing contacts and (ii) an electrical characteristic detector in electrical communication with the first and second sensing contacts.

17. The method of claim 16, comprising:

outputting, in response to the determining step, the alarm signal via the electrical characteristic detector.

18. The method of claim 17, comprising:

presenting, in response to the outputting step, a sensory output.

19. The method of claim 15, comprising:

changing a process parameter, in response to the detecting step, when at least one of the electrical potential and the electrical resistance achieves a predetermined threshold.

20. The method of claim 19, wherein the changing step comprises at least one of the following steps:

decreasing the flow rate of the molten liquid into the container;

repositioning the tip of the spout to a different location in the electrolysis cell; and terminating the passing the molten liquid step.

* * * * *